US009600007B2

(12) United States Patent
Su et al.

(10) Patent No.: US 9,600,007 B2
(45) Date of Patent: Mar. 21, 2017

(54) LOW DROPOUT REGULATOR WITH WIDE INPUT VOLTAGE RANGE

(71) Applicant: National Taipei University of Technology, Taipei (TW)

(72) Inventors: Ting-Wen Su, Taipei (TW); Yuh-Shyan Hwang, Taipei (TW)

(73) Assignee: NATIONAL TAIPEI UNIVERSITY OF TECHNOLOGY, Taipei (TW)

( * ) Notice: Subject to any disclaimer, the term of this patent is extended or adjusted under 35 U.S.C. 154(b) by 112 days.

(21) Appl. No.: 14/811,091

(22) Filed: Jul. 28, 2015

(65) Prior Publication Data

US 2017/0031374 A1 Feb. 2, 2017

(51) Int. Cl.
*G05F 1/575* (2006.01)

(52) U.S. Cl.
CPC ..... *G05F 1/575* (2013.01)

(58) Field of Classification Search
CPC . H02M 2001/0003; H02M 2001/0025; H02M 2001/0041; H02M 3/02; H02M 3/135; H02M 3/137; H02M 3/155; H02M 3/156; H02M 3/158; G05F 1/56; G05F 1/575
USPC ..... 323/269, 270, 273, 275, 279, 280, 299, 323/303
See application file for complete search history.

(56) References Cited

U.S. PATENT DOCUMENTS

| | | | | |
|---|---|---|---|---|
| 6,040,736 | A * | 3/2000 | Milanesi | G05F 1/575 323/316 |
| 8,686,707 | B2 * | 4/2014 | Kung | G05F 1/575 323/283 |
| 9,417,646 | B2 * | 8/2016 | Yasusaka | G05F 1/575 |
| 9,461,539 | B2 * | 10/2016 | Chern | H02M 3/156 |
| 9,477,244 | B2 * | 10/2016 | Luo | G05F 1/56 |
| 2005/0231180 | A1 * | 10/2005 | Nagata | G05F 1/575 323/268 |
| 2013/0063107 | A1 * | 3/2013 | Nishida | H02M 3/1588 323/271 |
| 2015/0061623 | A1 * | 3/2015 | Lee | G05F 1/575 323/280 |
| 2016/0116927 | A1 * | 4/2016 | Chen | H02M 1/36 323/280 |

* cited by examiner

*Primary Examiner* — Timothy J Dole
*Assistant Examiner* — Shahzeb K Ahmad
(74) *Attorney, Agent, or Firm* — DLA Piper LLP (US)

(57) ABSTRACT

A regulator for converting a DC input voltage into a DC output voltage includes: a control module generating a predetermined regulated voltage associated with the DC output voltage, and further generating a control signal based on a feedback voltage associated with the DC output voltage; a switching module outputting, in response to the control signal, one of the reference voltage and the regulated voltage as a switching voltage; and a conversion module generating the DC output voltage and the feedback voltage based on the DC input voltage, a reference voltage output from the reference voltage generation module and the switching voltage.

8 Claims, 8 Drawing Sheets

LOW DROPOUT REGULATOR WITH WIDE INPUT VOLTAGE RANGE

FIELD

The disclosure relates to a regulator, and more particularly to a low dropout regulator with wide input voltage.

BACKGROUND

FIG. 1 illustrates a conventional regulator for converting a variable DC input voltage ($V_{IN}$) ranging, for example, from 7V to 40V, into a DC output voltage ($V_{OUT}$) of, for example, 5V. The conventional regulator includes a reference voltage generation module 1' that is operable to generate a first reference voltage output (Vrf1) and a second reference voltage (Vrf2) based on the DC input voltage ($V_{IN}$), and a conversion module 5' that is coupled to the reference voltage generation module 1' and that is operable to generate the DC output voltage ($V_{OUT}$) based on the DC input voltage ($V_{IN}$), on the first reference voltage output (Vrf1) and on the second reference voltage (Vrf2) from the reference voltage generation module 1'.

Referring further to FIG. 2A, the reference voltage generation module 1' has an input terminal (P1) for receiving the DC input voltage ($V_{IN}$), and includes first to sixth transistors 11-16 and a resistor 17. The first, fourth and fifth transistors 11, 14, 15 are PMOS transistors, and the second, third and sixth transistors 12, 13, 16 are NMOS transistors. The first to third transistors 11, 12, 13 are coupled sequentially in series between the input terminal (P1) and ground. The fourth to sixth transistors 14, 15, 16 and the resistor 17 are coupled sequentially in series between the input terminal (P1) and ground. Sources of the first and fourth transistors 11, 14 are coupled to the input terminal (P1). Gates of the first and fourth transistors 11, 14, drain of the fourth transistor 14 and source of the fifth transistor 15 are coupled to each other. Drains of the first and second transistors 11, 12 and gate of the second transistor 12 are coupled to each other. A source of the second transistor 12, a drain of the third transistor 13, and gates of the third and sixth transistors 13, 16 are coupled to each other. A gate and a drain of the fifth transistor 15, and a drain of the sixth transistor 16 are coupled to each other. Sources of the third and sixth transistors 13, 16 are coupled respectively to ground and one end of the resistor 17. The other end of the resistor 17 is coupled to ground. The potential at a common node (P2) among the gate of the first transistor 11, the gate and drain of the fourth transistor 14 and the source of the fifth transistor 15 serves as a first voltage (V1). The potential at a common node (P3) among the gate and drain of the fifth transistor 15 and the drain of the sixth transistor 16 serves as a second voltage (V2). The potential at a common node (P4) between the gate and drain of the second transistor 12 serves as a third voltage (V3). The potential at a common node (P5) among the gate and drain of the third transistor 13 and the gate of the sixth transistor 16 serves as the second reference voltage (Vrf2). The first, second and third voltages (V1, V2, V3) cooperatively constitute the first reference voltage output (Vrf1).

Referring to FIG. 2B, the conversion module 5' includes an error amplifier circuit 51, and a voltage division circuit 52 coupled to the error amplifier circuit 51.

The error amplifier circuit 51 receives the first to third voltages (V1, V2, V3) (i.e., the first reference voltage output (Vrf1)) and the second reference voltage (Vrf2) from the reference voltage generation module 1'. The error amplifier circuit 51 is operable to generate an amplified signal (As) based on the first to third voltages (V1, V2, V3), on the second reference voltage (Vrf2) and on a divided voltage (Vd) associated with the DC output voltage ($V_{OUT}$). The error amplifier circuit 51 includes a first transistor 511, a differential pair 50 of second and third transistors 512, 513, fourth and fifth transistors 514, 515, and first to eighth bias transistors 531-538. The transistors 511, 512, 513, 531, 532, 535, 536 are PMOS transistors, and the transistors 514, 515, 533, 534, 537, 538 are NMOS transistors. Each of the first to fifth transistors 511-515 and the first to eight bias transistors 531-538 has a source, drain and gate that serve respectively as a first terminal, a second terminal and a control terminal. The source and gate of the first transistor 511 receive respectively the DC input voltage ($V_{IN}$) and the first voltage (V1) (from the common node (P2) of the reference voltage generation module 1' (FIG. 2A)). The drain of the first transistor 511 and the sources of the second and third transistors 512, 513 are coupled to each other. The gates of the second and third transistors 512, 513 receive respectively the divided voltage (Vd) and the second reference voltage (Vrf2) (from the common node (P5) of the reference voltage generation module 1' (FIG. 2A)). The drain of the second transistor 512, and the drain and gate of the fourth transistor 514 are coupled to each other. The drain of the third transistor 513, and the drain and gate of the fifth transistor 515 are coupled to each other. The sources of the fourth and fifth transistors 514, 515 are coupled to ground. The first to fourth bias transistors 531, 532, 533, 534 are coupled sequentially in series between the source of the first transistor 511 and ground. The fifth to eighth bias transistors 535, 536, 537, 538 are coupled sequentially in series between the source of the first transistor 511 and ground. The sources of the first and fifth bias transistors 531, 535 are coupled to the source of the first transistor 511, thereby receiving the DC input voltage ($V_{IN}$). The drain of the first bias transistor 531 is coupled to the source of the second bias transistor 532. The gates of the first and fifth bias transistors 531, 535, and the drains of the second and third bias transistors 532, 533 are coupled to each other at a first common node (n1). The gates of the second and sixth bias transistors 532, 536 are coupled to each other for receiving the second voltage (V2) from the common node (P3) of the reference voltage generation module 1' (FIG. 2A). The gates of the third and seventh bias transistors 533, 537 are coupled to each other for receiving the third voltage (V3) from the common node (P4) of the reference voltage generation module 1' (FIG. 2A). The drain, source and gate of the fourth bias transistor 534 are coupled respectively to the source of the third bias transistor 533, ground and the drain of the third transistor 513. The drain of the fifth bias transistor 535 is coupled to the source of the sixth bias transistor 536. The drains of the sixth and seventh bias transistors 536, 537 are coupled to each other at a second common node (n2). The drain, source and gate of the eighth bias transistor 538 are coupled respectively to the source of the seventh bias transistor 537, ground and drain of the second transistor 512.

Thus, the first to third transistors 511, 512, 513 are operable to be conducting or non-conducting in response, respectively, to the first voltage (V1), the divided voltage (Vd) and the second reference voltage (Vrf2). The second and sixth bias transistors 532, 536 are operable to be conducting or non-conducting in response to the second voltage (V2). The third and seventh bias transistors 533, 537 are operable to be conducting or non-conducting in response to the third voltage (V3). The amplified signal (As) is outputted at the second common node (n2).

The voltage division circuit 52 receives the DC input voltage ($V_{IN}$), and the amplified signal (As) from the second common node (n2) of the error amplifier circuit 51. The voltage division circuit 52 is operable to generate, based on the DC input voltage ($V_{IN}$) and the amplified signal (As), the DC output voltage ($V_{OUT}$) and the divided voltage (Vd). The voltage division circuit 52 includes a sixth transistor 521, and first to third resistors 522, 523, 524 coupled sequentially in series between the sixth transistor 521 and ground. The sixth transistor 521 is a PMOS transistor that has a source for receiving the DC input voltage ($V_{IN}$), a gate coupled to the second common node (n2) for receiving the amplified signal (As) therefrom, and a drain coupled to one end of the first resistor 522. When the sixth transistor 521 conducts in response to the amplified signal (As), a voltage across the first to third resistors 522, 523, 524 is outputted to serve as the DC output voltage ($V_{OUT}$), and a voltage across the third resistor 524 is outputted to serve as the divided voltage (Vd).

In such a configuration, as the DC input voltage ($V_{IN}$) initially increases from zero, the second reference voltage (Vrf2) outputted at the common node (P5) of the reference voltage generation module 1' increases until reaching a gate-to-source voltage of the third transistor 13. Thereafter, the second reference voltage (Vrf2) remains unchanged and is thus insensitive to the increase of the DC input voltage ($V_{IN}$). As a result, the conventional regulator may not output the DC output voltage ($V_{OUT}$) in a stable way after the second reference voltage (Vrf2) reaches the gate-to-source voltage of the third transistor 13.

SUMMARY

Therefore, an object of the disclosure is to provide a low dropout regulator with wide input voltage that can alleviate the drawback of the prior art.

According to the disclosure, there is provided a regulator for converting a DC input voltage into a DC output voltage. The regulator of this disclosure includes a reference voltage generation module, a control module, a switching module and a conversion module.

The reference voltage generation module is used to receive the DC input voltage, and is operable to generate a first reference voltage output and a second reference voltage based on the DC input voltage.

The control module is operable to generate a predetermined regulated voltage associated with the DC output voltage, and to further generate a control signal based on a feedback voltage associated with the DC output voltage.

The switching module is coupled to the reference voltage generation module and the control module for receiving the second reference voltage from the reference voltage generation module, and the predetermined regulated voltage and the control signal from the control module. The switching module is operable to output, in response to the control signal, one of the second reference voltage and the predetermined regulated voltage to serve as a switching voltage.

The conversion module is used to receive the DC input voltage, and is coupled to the reference voltage generation module, the control module and the switching module. The conversion module further receives the first reference voltage output from the reference voltage generation module, and the switching voltage from the switching module. The conversion module is operable to generate the DC output voltage and the feedback voltage based on the DC input voltage, the first reference voltage output and the switching voltage.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
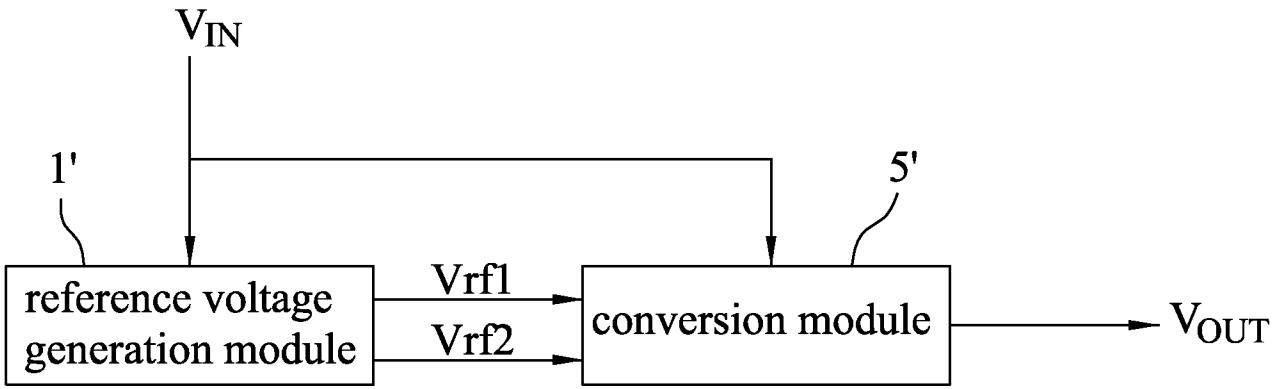
FIG.1 PRIOR ART
FIG. 1 is a schematic block diagram illustrating a conventional regulator.

Before this disclosure is described in detail, it should be noted herein that throughout this disclosure, like elements are denoted by the same reference numerals. In addition, when two elements are described as being "coupled in series," "connected in series" or the like, it is merely intended to portray a serial connection between the two elements without necessarily implying that the currents flowing through the two elements are identical to each other and without limiting whether or not an additional element is coupled to a common node between the two elements. Essentially, "a series connection of elements," "a series coupling of elements" or the like as used throughout this disclosure should be interpreted as being such when looking at those elements alone.

Figure 3:
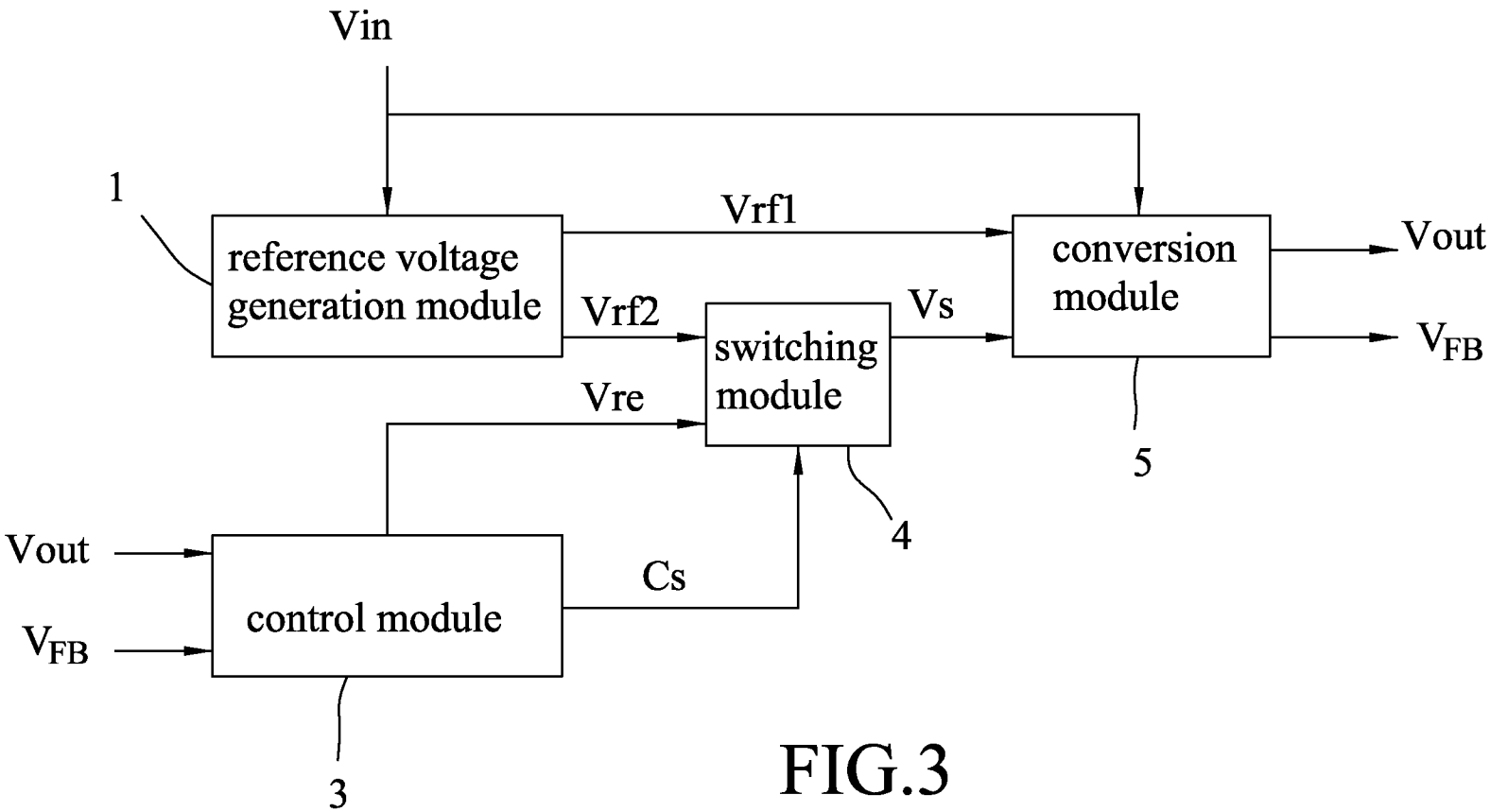
FIG. 3 is a schematic block diagram illustrating the embodiment of a regulator according to the disclosure.
Figure 4:
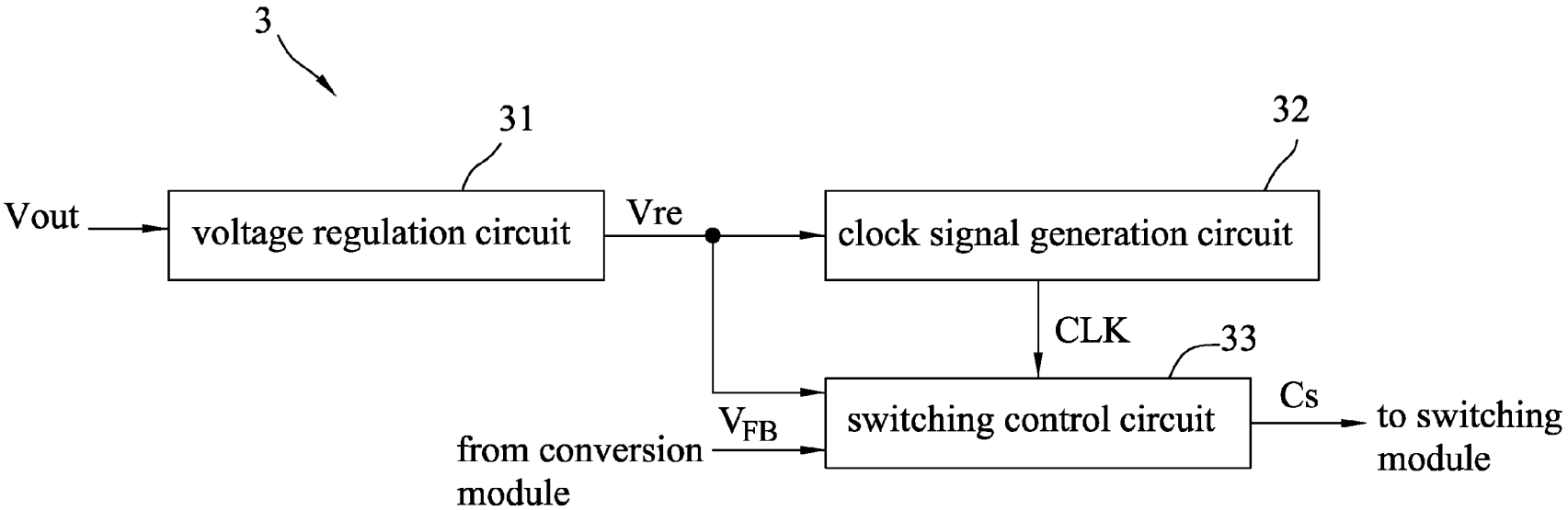
FIG. 4 is a schematic block diagram illustrating a control module of the embodiment.

Referring to FIG. 3, the embodiment of a low dropout regulator with wide input voltage according to the disclosure is adapted for converting a variable DC input voltage (Vin) ranging, for example, from 7V to 40V, into a stable DC output voltage (Vout) of, for example, 5V. The regulator of this disclosure includes a reference voltage generation module 1, a control module 3, a switching module 4 and a conversion module 5. It is noted that the DC output voltage (Vout) is also used to serve as a bias voltage for operation of the control module 3.

Figure 2A:
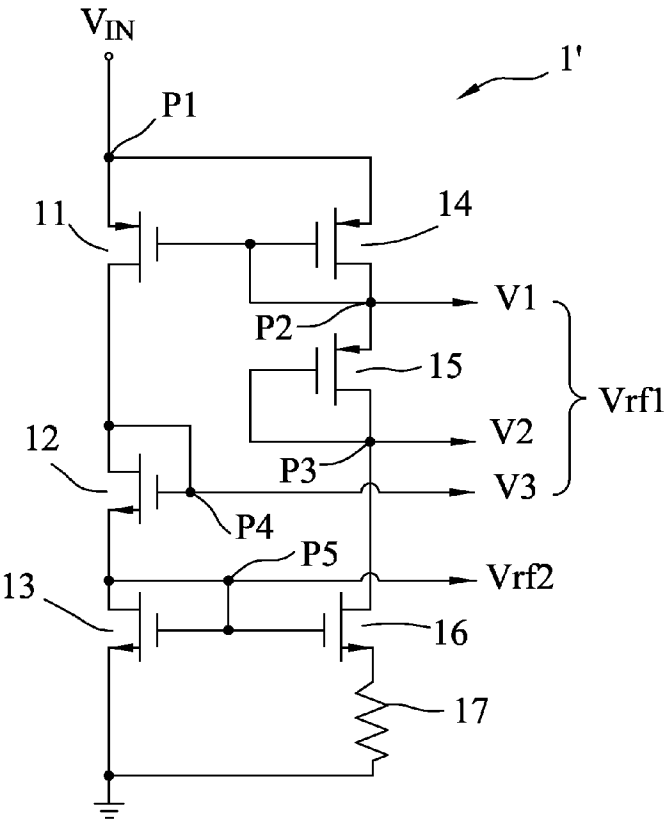
FIG.2A PRIOR ART
FIG. 2A is a schematic electrical circuit diagram illustrating a reference voltage generation module of the conventional regulator.

The reference voltage generation module 1 is used to receive the DC input voltage (Vin), and is operable to generate a first reference voltage output (Vrf1) and a second reference voltage (Vrf2) based on the DC input voltage (Vin). In this embodiment, for example, the reference voltage generation module 1 may have the same configuration and operation as those of the reference voltage generation module 1' of FIG. 2A. Thus, similarly, the first reference voltage output (Vrf1) is the same as that of FIG. 2A, which consists of the first to third voltages (V1-V3), and the second reference voltage (Vrf2) is the same as that of FIG. 2A.

The control module 3 is operable to generate a predetermined regulated voltage (Vre) associated with the DC output voltage (Vout), and to generate a control signal (Cs) based on a feedback voltage (VFB) associated with the DC output voltage (Vout). In this embodiment, referring further to FIG.

4, the control module 3 includes a voltage regulation circuit 31, a clock signal generation circuit 32 and a switching control circuit 33. The voltage regulation circuit 31 is used to generate the predetermined regulated voltage (Vre). The clock signal generation circuit 32 is coupled to the voltage regulation circuit 31 for receiving the predetermined regulated voltage (Vre) therefrom, and is operable to generate a clock signal (CLK) based on the predetermined regulated voltage (Vre). The switching control circuit 33 is coupled to the voltage regulation circuit 31, the clock signal generation circuit 32 and the conversion module 5. The switching control circuit 33 receives the predetermined regulated voltage (Vre) from the voltage regulation circuit 31, the clock signal (CLK) from the clock signal generation circuit 32, and the feedback voltage ($V_{FB}$) from the conversion module 5. The switching control circuit 33 is operable to generate the control signal (Cs) based on the predetermined regulated voltage (Vre), the clock signal (CLK) and the feedback voltage ($V_{FB}$), and to output the control signal (Cs) to the switching module 4.

Figure 5:
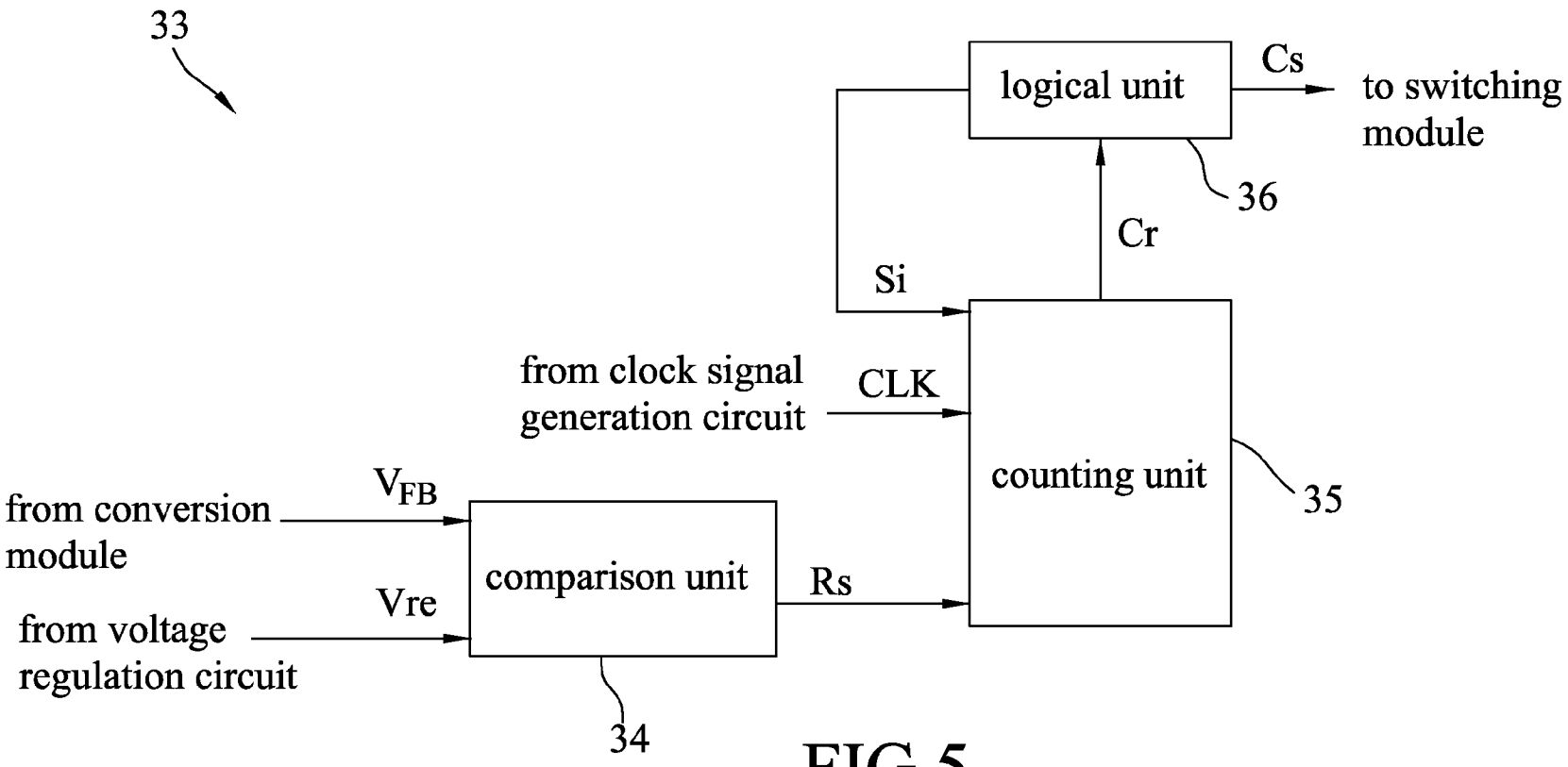
FIG. 5 is a schematic block diagram illustrating a switching control circuit of the control module of the embodiment.
Figure 6:
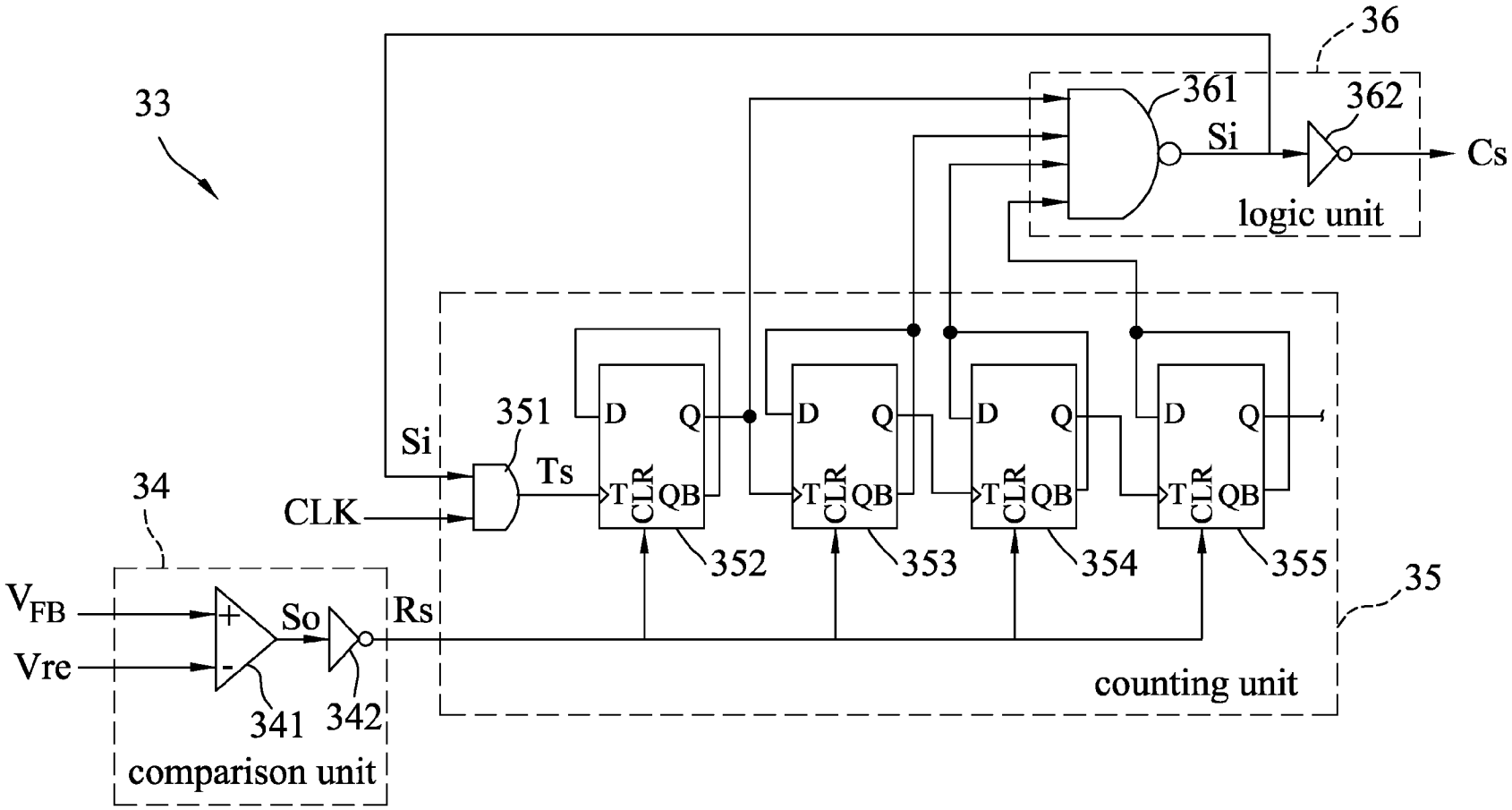
FIG. 6 is a schematic electrical circuit diagram illustrating the switching control circuit of the control module of the embodiment.

In this embodiment, referring further to FIGS. 5 and 6, the switching control circuit 33 includes a comparison unit 34, a counting unit 35 and a logic unit 36.

The comparison unit 34 is coupled to the conversion module 5 and the voltage regulation circuit 31 for receiving the feedback voltage ($V_{FB}$) and the predetermined regulated voltage (Vre) respectively therefrom. The comparison unit 34 is operable to generate, based on the feedback voltage ($V_{FB}$) and the predetermined regulated voltage (Vre), a reset signal (Rs). The comparison unit 34 may include, but is not limited to, a comparator 341 and a NOT gate 342. The comparator 341 has a non-inverting input end for receiving the feedback voltage ($V_{FB}$), an inverting input end that is coupled to the voltage regulation circuit 31 for receiving the predetermined regulated voltage (Vre) therefrom, and an output end. The comparator 341 compares the predetermined regulated voltage (Vre) and the feedback voltage ($V_{FB}$) so as to generate an output signal (So) at the output end thereof. The NOT gate 342 has an input terminal that is coupled to the output end of the comparator 341 for receiving the output signal (So) therefrom, and an output terminal that outputs the reset signal (Rs) generated by the NOT gate 342 from the output signal (So).

The counting unit 35 is coupled to the clock signal generation circuit 32 and the comparison unit 34 for receiving the clock signal (CLK) and the reset signal (Rs) respectively therefrom. The counting unit 35 is operable to generate, based on an input signal (Si), the clock signal (CLK) and the reset signal (Rs), a counting result (Cr) associated with a predetermined period of time. The counting unit 35 may include, but is not limited to, an AND gate 351, and a number N of cascaded D-type flip-flops, where N is associated with the predetermined period of time. In this embodiment, for example, N=4. Therefore, four cascaded D-type flip-flops 352, 353, 354, 355 are shown in FIG. 6, respectively referred to as first, second, third and fourth D-type flip-flops 352, 353, 354, 355 hereinafter for the sake of simplicity of explanation. However, in other embodiments, when the predetermined period of time is longer, N may be greater than four. The AND gate 351 has a first input end for receiving the input signal (Si), a second input end that is coupled to the clock signal generation circuit 32 for receiving the clock signal (CLK) therefrom, and an output end. The AND gate 351 outputs a trigger signal (Ts) at its output end in response to the input signal (Si) and the clock signal (CLK). Each of the D-type flip-flops 352, 353, 354, 355 has a data input (D) and an inverting data output (QB) that are coupled to each other, a trigger signal input (T), a non-inverting data output (Q), and a reset signal input (CLR) that is coupled to the output end of the NOT gate 342 for receiving the reset signal (Rs) therefrom. The trigger signal input (T) of the first D-type flip-flop 352 is coupled to the output end of the AND gate 351 for receiving the trigger signal (Ts). The trigger signal input (T) of an $i^{th}$ one of the D-type flip-flops is coupled to the non-inverting data output (Q) of an $(i-1)^{th}$ one of the D-type flip-flops, where $2 \le i \le 4$. Each of the D-type flip-flops 352, 353, 354, 355 outputs a respective bit signal and a respective inverted bit signal respectively at its non-inverting data output (Q) and its inverting data output (QB). The bit signal outputted at the non-inverting data output (Q) of the first D-type flip-flop 352, and the inverted bit signals outputted respectively at the inverting data outputs (QB) of the second to fourth D-type flip-flops 353, 354, 355 cooperatively constitute the counting result (Cr).

The logic unit 36 is coupled to the counting unit 35 for receiving the counting result (Cr) therefrom, and to the switching module 4. The logic unit 36 is operable to generate the input signal (Si) and the control signal (Cs) based on the counting result (Cr). The logic unit 36 may include, but is not limited to, a NAND gate 361 for generating the input signal (Si) and a NOT gate 362 for generating the control signal (Cs). In this embodiment, the NAND gate 361 has, for example, four input terminals that are coupled respectively to the non-inverting data output (Q) of the D-type flip-flop 352 and the inverting data outputs (QB) of the second to fourth D-type flip-flops 353, 354, 355 for receiving the bit signal and the inverted bit signals respectively therefrom, and an output terminal that is coupled to the first input end of the AND gate 351 of the counting unit 35 for outputting the input signal (Si) thereto. The NOT gate 362 has an input end that is coupled to the output terminal of the NAND gate 361 for receiving the input signal (Si) therefrom, and an output end for outputting the control signal (Cs).

Referring again to FIG. 3, the switching module 4 is coupled to the reference voltage generation module 1 and the control module 3 for receiving the second reference voltage (Vrf2) from the reference voltage generation module 1, and the predetermined regulated voltage (Vre) and the control signal (Cs) from the control module 3. The switching module 4 is operable to output, in response to the control signal (Cs), one of the second reference voltage (Vrf2) and the predetermined regulated voltage (Vre) to serve as a switching voltage (Vs). It is noted that, in this embodiment, when the feedback voltage ($V_{FB}$) has been greater than the predetermined regulated voltage (Vre) for the predetermined period of time, the switching module 4 outputs the predetermined regulated voltage (Vre) as the switching voltage (Vs); otherwise, the second reference voltage (Vrf2) is outputted as the switching voltage (Vs).

The conversion module 5 is used to receive the DC input voltage (Vin), and is coupled to the reference voltage generation module 1, the control module 3 and the switching module 4. The conversion module 5 further receives the first reference voltage output (Vrf1) from the reference voltage generation module 1, and the switching voltage (Vs) from the switching module 4. The conversion module 5 is operable to generate, based on the DC input voltage (Vin), the first reference voltage output (Vrf1) and the switching voltage (Vs), the DC output voltage (Vout) and the feedback voltage ($V_{FB}$).

Figure 2B:
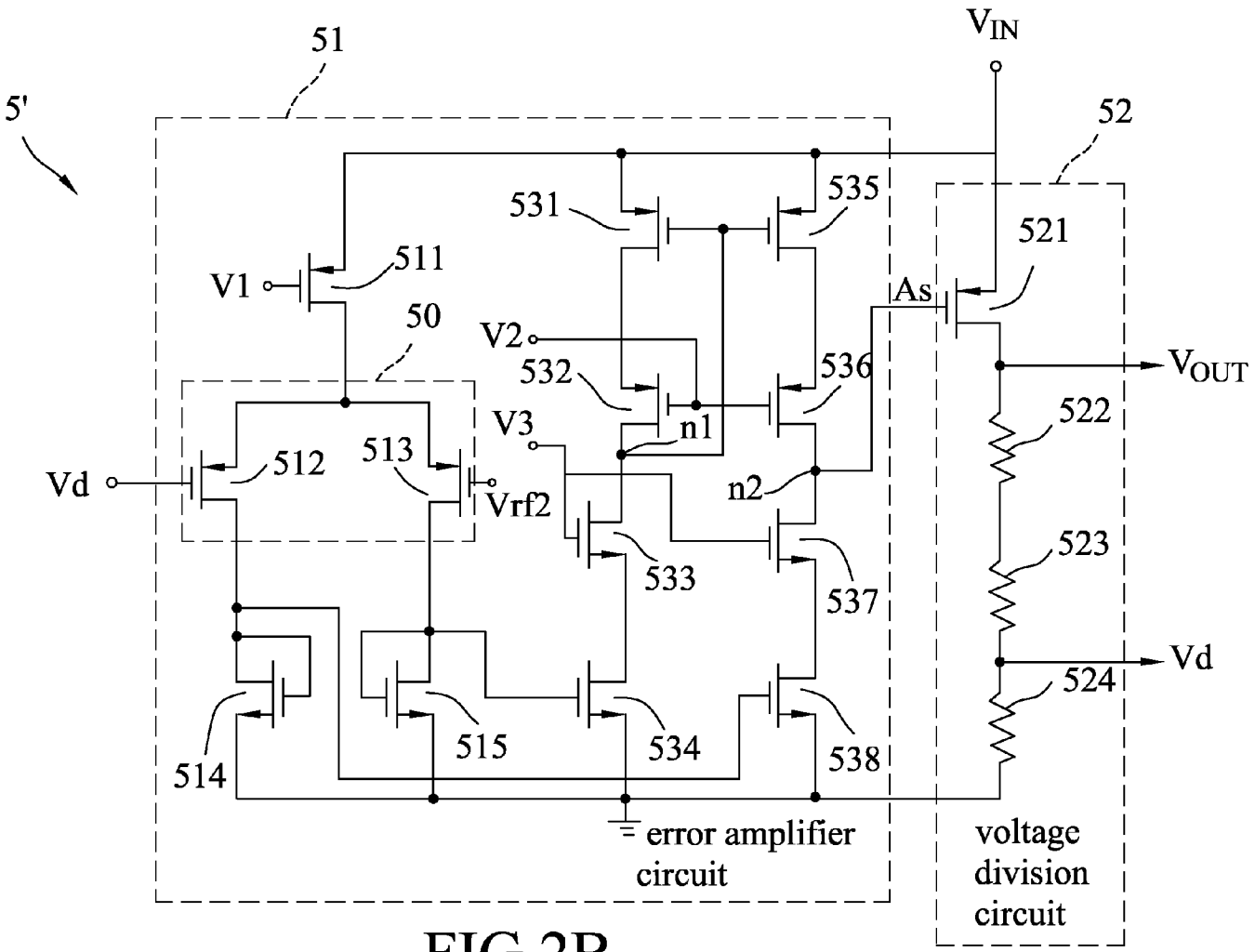
FIG.2B PRIOR ART
FIG. 2B is a schematic electrical circuit diagram illustrating a conversion module of the conventional regulator.
Figure 7:
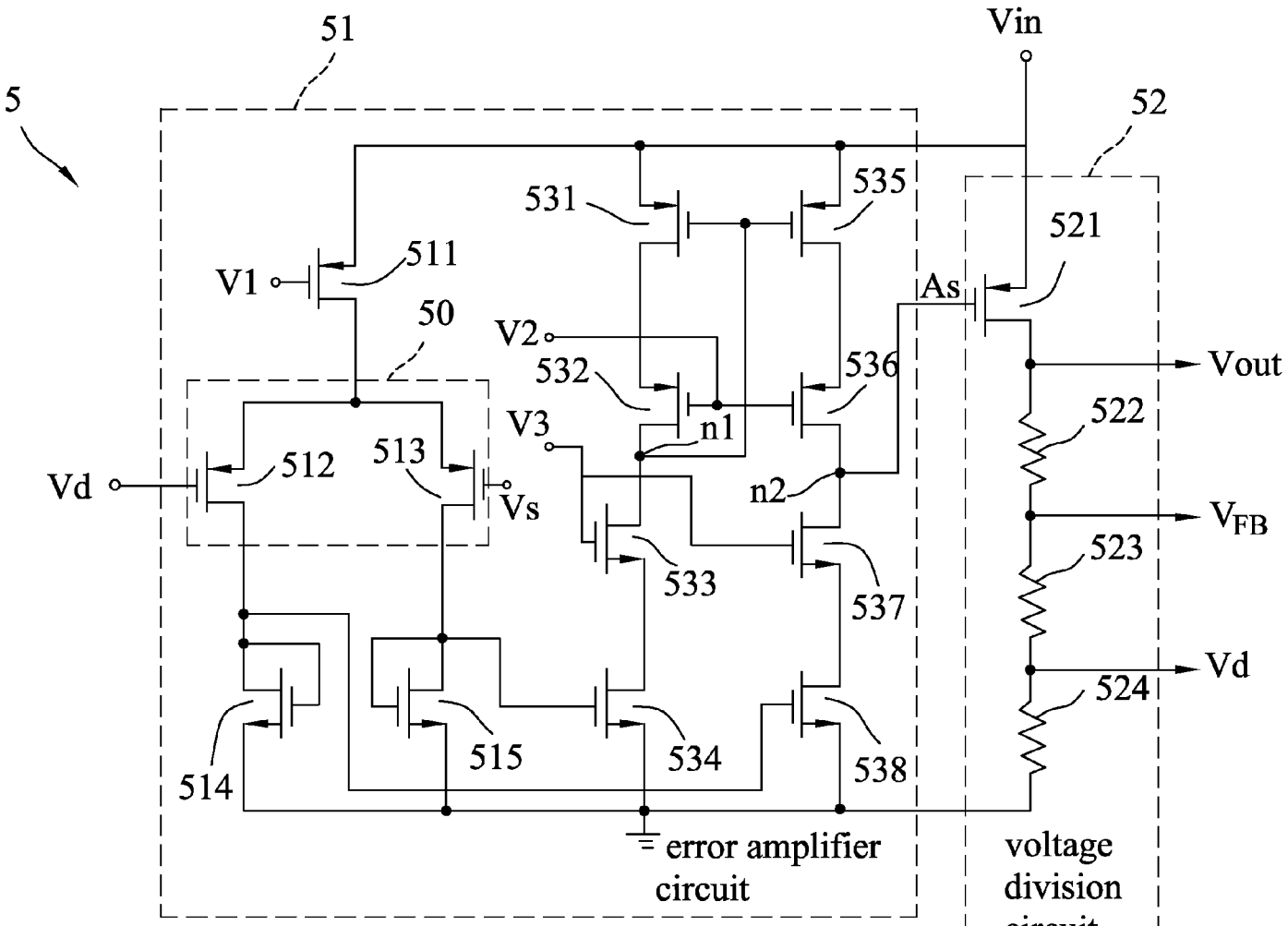
FIG. 7 is a schematic electrical circuit diagram illustrating a conversion module of the embodiment.

In this embodiment, referring further to FIG. 7, the conversion module 5 may have, for example, its configuration and operation similar to those of the conversion module 5' of FIG. 2B. The conversion module 5 of FIG. 7 differs from the conventional module 5' of FIG. 2B in that the gate of the third transistor 513 receives the switching voltage (Vs) from the switching module 4 and that the voltage division circuit 52 further outputs the feedback voltage ($V_{FB}$) that is a voltage across the second and third resistors 523, 524. It is noted that the DC output voltage (Vout) is greater than the feedback voltage ($V_{FB}$), and the feedback voltage ($V_{FB}$) is greater than the divided voltage (Vd). Thus, the amplified signal (As) is generated by the error amplifier circuit 51 based on the first to third voltages (V1-V3) (i.e., the first reference voltage output (Vrf1)), on the switching voltage (Vs) and on the divided voltage (Vd).

As an example, the ratio of the DC output voltage (Vout) to the feedback voltage ($V_{FB}$) is 50/16. Initially, when the DC input voltage (Vin) increases in a way that the DC output voltage (Vout) gradually increases, for example, from 0V to about 3V, the voltage regulation circuit 31 of the control module 3 is able to generate the predetermined regulated voltage (Vre) of about 1.2V. In this case, since the feedback voltage ($V_{FB}$) being 0.96V (=3×16/50V) is less than the predetermined regulated voltage (Vre), all the D-type flip-flops 352-355 (FIG. 6) are reset/cleared. Thereafter, when the DC output voltage (Vout) is greater than 3.75V (=1.2×50/16V), the counting unit 35 begins to count from 0000 to 1000. At the same time, the feedback voltage ($V_{FB}$) has been greater than the predetermined regulated voltage (Vre) for the predetermined period of time. Thus, the switching module 4 outputs the predetermined regulated voltage (Vre) as the switching voltage (Vs) in response to the control signal (Cs) from the logic unit 36 (FIG. 5). As a result, the conversion module 5 is able to stably output the DC output voltage (Vout) of 5V based on the switching voltage (Vs) and the first reference voltage output (Vrf1) (FIG. 3).

To sum up, due to the presence of the control module 3 and the switching module 4, the regulator of this disclosure can convert the DC input voltage (Vin) into the DC output voltage (Vout) in a stable way regardless of variation in the DC input voltage (Vin).

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A regulator for converting a DC input voltage into a DC output voltage, said regulator comprising:

a reference voltage generation module used to receive the DC input voltage, and operable to generate a first reference voltage output and a second reference voltage based on the DC input voltage;

a control module operable to generate a predetermined regulated voltage associated with the DC output voltage, and to further generate a control signal based on a feedback voltage associated with the DC output voltage;

a switching module coupled to said reference voltage generation module and said control module for receiving the second reference voltage from said reference voltage generation module, and the predetermined regulated voltage and the control signal from said control module, said switching module being operable to output, in response to the control signal, one of the second reference voltage and the predetermined regulated voltage to serve as a switching voltage; and a conversion module used to receive the DC input voltage, and coupled to said reference voltage generation module, said control module and said switching module, said conversion module further receiving the first reference voltage output from said reference voltage generation module, and the switching voltage from said switching module, said conversion module being operable to generate the DC output voltage and the feedback voltage based on the DC input voltage, the first reference voltage output and the switching voltage.

2. The regulator as claimed in claim 1, wherein the DC output voltage serves as a bias voltage for operation of said control module.

3. The regulator as claimed in claim 1, wherein said switching module outputs the predetermined regulated voltage as the switching voltage based on the control signal when the feedback voltage has been greater than the predetermined regulated voltage for a predetermined period of time.

4. The regulator as claimed in claim 3, wherein said control module includes:

a voltage regulation circuit for generating the predetermined regulated voltage;

a clock signal generation circuit coupled to said voltage regulation circuit for receiving the predetermined regulated voltage therefrom, said clock signal generation circuit being operable to generate a clock signal based on the predetermined regulated voltage; and a switching control circuit coupled to said voltage regulation circuit, said clock signal generation circuit and said conversion module, said switching control circuit receiving the predetermined regulated voltage from said voltage regulation circuit, the clock signal from said clock signal generation circuit, and the feedback voltage from said conversion module, said switching control circuit being operable to generate the control signal based on the predetermined regulated voltage, the clock signal and the feedback voltage.

5. The regulator as claimed in claim 4, wherein said switching control circuit of said control module includes:

a comparison unit coupled to said conversion module and said voltage regulation circuit for receiving the feedback voltage and the predetermined regulated voltage respectively therefrom, said comparison unit being operable to generate, based on the feedback voltage and the predetermined regulated voltage, a reset signal;

a counting unit coupled to said clock signal generation circuit and said comparison unit for receiving the clock signal and the reset signal respectively therefrom, said counting unit being operable to generate, based on an input signal, the clock signal and the reset signal, a count ing re suit associated with the predetermined period of time; and a logic unit coupled to said counting unit for receiving the counting result therefrom, and to said switching module, said logic unit being operable to generate the input signal and the control signal based on the counting result.

6. The regulator as claimed in claim 5, wherein:

said comparison unit includes a comparator having a non-inverting input end coupled to said conversion module for receiving the feedback voltage therefrom, an inverting input end coupled to s aid voltage regulation circuit for receiving the predetermined regulated voltage therefrom, and an output end, said comparator comparing the predetermined regulated voltage and the feedback voltage so as to generate an output signal at said output end thereof, and a NOT gate having an input terminal coupled to said output end of said comparator for receiving the output signal therefrom, and an output terminal for outputting the reset signal that is generated by said NOT gate from the output signal;

said counting unit includes an AND gate having a first input end coupled to said logic unit for receiving the input signal therefrom, a second input end coupled to said clock signal generation circuit for receiving the clock signal therefrom, and an output end, said AND gate outputting a trigger signal at said output end thereof in response to the input signal and the clock signal, and a number N of cascaded D-type flip-flops, each of which has a data input and an inverting data output coupled to each other, a trigger signal input, a non-inverting data output, and a reset signal input coupled to said output end of said NOT gate of said comparison unit for receiving the reset signal therefrom, where N is associated with the predetermined period of time, each of said D-type flip-flops outputting a respective bit signal and a respective inverted bit signal respectively at said non-inverting data output and said inverting data output thereof, said trigger signal input of a first one of said D-type flip-flops being coupled to said output end of said AND gate for receiving the trigger signal, said trigger signal input of an $i^{th}$ one of said D-type flip-flops being coupled to said non-inverting data output of an $(i-1)^{th}$ one of said D-type flip-flops, where $2 \leq i \leq N$, the bit signal outputted at said non-inverting data output of a first one of said D-type flip-flops, and the inverted bit signals outputted respectively at said inverting data outputs of second to $N^{th}$ ones of said D-type flip-flops cooperatively constituting the counting result; and said logic unit includes a NAND gate having a number N of input terminals coupled respectively to said non-inverting data output of the first one of said D-type flip-flops and said inverting data outputs of the second to $N^{th}$ ones of said D-type flip-flops for receiving the bit signal and the inverted bit signals respectively therefrom, and an output terminal for outputting the input signal, and a NOT gate having an input end coupled to said output terminal of said NAND gate for receiving the input signal therefrom, and an output end for outputting the control signal.

7. The regulator as claimed in claim 1, wherein said conversion module includes:

an error amplifier circuit used to receive the DC input voltage, and coupled to said reference voltage generation module and said switching module for receiving the first reference voltage output and said switching voltage respectively therefrom, said error amplifier circuit being operable to generate an amplified signal based on the first reference voltage output, on the switching voltage and on a divided voltage associated with the DC output voltage; and a voltage division circuit used to receive the DC input voltage, and coupled to said error amplifier circuit for receiving the amplified signal therefrom, said voltage division circuit being operable to generate, based on the DC input voltage and the amplified signal, the DC output voltage, the feedback voltage and the divided voltage, said DC output voltage being greater than the feedback voltage and the feedback voltage being greater than the divided voltage.

8. The regulator as claimed in claim 7, wherein:

the first reference voltage output generated by said reference voltage generation module includes a first voltage, a second voltage and a third voltage;

said error amplifier circuit includes a first transistor having a first terminal that is used to receive the DC input voltage, a second terminal, and a control terminal that is used to receive the first voltage, a differential pair of second and third transistors, each of which has a first terminal that is coupled to said second terminal of said first transistor, a second terminal, and a control terminal, said control terminals of said second and third transistors being used to respectively receive the divided voltage and the switching voltage, a fourth transistor having a grounded first terminal, and a second terminal and a control terminal coupled to said second terminal of said second transistor, a fifth transistor having a grounded first terminal, and a second terminal and a control terminal coupled to said second terminal of said third transistor, first to fourth bias transistors coupled sequentially in series between said first terminal of said first transistor and ground, each of said first to fourth bias transistors having a first terminal, a second terminal and a control terminal, said first and second terminals of said first bias transistor being coupled respectively to said first terminal of said first transistor and said first terminal of said second bias transistor, said control terminal of said first bias transistor being coupled to a first common node between said second terminals of said second and third bias transistors, said second terminal and said control terminal of said fourth bias transistor being coupled respectively to said first terminal of said third bias transistor and said second terminal of said third transistor of said differential pair, said control terminals of said second and third bias transistors receiving respectively the second and third voltages of the first reference voltage output, and fifth to eighth bias transistors coupled sequentially in series between said first terminal of said first transistor and ground, each of said fifth to eight bias transistors having a first terminal, a second terminal and a control terminal, said first and second terminals and said control terminal of said fifth bias transistor being coupled respectively to said first terminal of said first transistor, said first terminal of said sixth bias transistor and said control terminal of said first bias transistor, said second terminals of said sixth and seventh bias transistors being coupled to each other, said second terminal and said control terminal of said eighth bias transistor being coupled respectively to said first terminal of said seventh bias transistor and said second terminal of said second transistor of said differential pair, said control terminals of said sixth and seventh bias transistors receiving respectively the second and third voltages of the first reference voltage output, the amplified signal being outputted at a second common node between said second terminals of said sixth and seventh bias transistors; and said voltage division circuit includes a sixth transistor having a first terminal used to receive the DC input voltage, a second terminal, and a control terminal coupled to said second common node for receiving the amplified signal therefrom, and first to third resistors coupled sequentially in series between said second terminal of said sixth transistor and ground, when said sixth transistor conducts in response to the amplified signal, a voltage across said first to third resistors serving as the DC output voltage, a voltage across said second and third resistors serving as the feedback voltage, and a voltage across said third resistor serving as the divided voltage.

* * * * *